United States Patent [19]

Wimmer

[11] 4,047,535

[45] Sept. 13, 1977

[54] METHOD OF AND APPARATUS FOR IMPROVING SMOKING PROPERTIES OF TOBACCO PRODUCTS

[76] Inventor: Peter Wimmer, Wachtelweg 8, 4952 Barkhausen, Germany

[21] Appl. No.: 690,519

[22] Filed: May 27, 1976

[30] Foreign Application Priority Data

Mar. 29, 1976 Germany ..... 2613304

[51] Int. Cl.[2] ..... A24C 5/30

[52] U.S. Cl. ..... 131/23 R; 131/170 R; 131/83 A

[58] Field of Search ..... 131/170 R, 23 R, 94, 131/254, 253, 83

[56] References Cited

U.S. PATENT DOCUMENTS

| | | | |
|---|---|---|---|
| 2,694,399 | 11/1954 | Parker et al. | 131/170 R |
| 2,854,010 | 9/1958 | Stamm | 131/4 B X |
| 3,080,872 | 3/1963 | Granacher | 131/170 R |
| 3,483,873 | 12/1969 | Hinzmann | 131/170 R X |
| 3,701,353 | 10/1972 | Pasquine et al. | 131/170 R X |

*Primary Examiner*—Stephen C. Pellegrino

*Attorney, Agent, or Firm*—Allegretti, Newitt, Witcoff & McAndrews

[57] ABSTRACT

An apparatus for producing radial perforations in cigars or the like comprising a pair of rotating rolls, one having axial recesses in the surface to receive the cigars and the other having opposed pressure application strips, and fine, sharp needles projecting into the recesses, whereby the cigars are perforated as the rollers rotate. A method for perforating cigars in which the surface layers of tobacco are perforated in a predetermined pattern so that there is no delamination of the leaves.

12 Claims, 3 Drawing Figures

METHOD OF AND APPARATUS FOR IMPROVING SMOKING PROPERTIES OF TOBACCO PRODUCTS

BACKGROUND OF THE INVENTION

The invention relates to a method of and an apparatus for improving the pleasure obtained in smoking tobacco products, more particularly cigars and cigarillos.

It is known that the enjoyment obtained when smoking a cigar or cigarillo depends on the product smoked, and more particularly on how a cigar or a cigarillo "draws."

If the tobacco portions, leaves, etc, in the products are packed too tightly, the main smoke flow finds it difficult to pass through. This is a nuisance to the smoker, and has a disadvantageous effect on the pleasure he experiences from the tobacco smoke.

In fact a serious disadvantage results from this, in that the products being burned are incompletely burned when the smoker draws on the cigar, since the axial passage of the flow of air or smoke through the cigar is made difficult and thus an indadequate quantity of oxygen is supplied for the burning process. Therefore, a substantial proportion of the substances which can be burned are subjected only to low-temperature carbonization, so that the CO content in the smoke is relatively high.

As a result, not only is the smoking operation itself made difficult, but it also becomes unpleasant because of the high content of CO since the smoker wishes to inhale the active aromatic substances and not the gases resulting from incomplete combustion.

SUMMARY OF THE INVENTION

Therefore, the present invention has as its object to propose a method whereby these disadvantages are obviated.

This is achieved in that, in the covering and wrapping leaves of cigars and cigarillos, fine perforations are produced which are distributed over the length and circumference of the cigars and cigarillos in a uniform manner.

The perforations which are produced in the covering and wrapping leaves are intended to be in proportion to the product smoked; that is to say, more or larger perforations should be provided in the case of particularly thick cigars than are provided in the case of a thin cigarillo. In spite of this relationship, the perforations should not exceed 1 mm. in diameter as far as possible, and should be spaced sufficiently far from one another as not to prejudice the mechanical strength of the covering and wrapping leaf; that is to say, the perforations should be so arranged that the covering or wrapping leaves wound about the product smoked are not prejudiced by the perforating operation or by the perforations themselves as regards the proper leaf positions and the way they hold onto the product. They should not readily detach.

Producing the perforations in the covering and wrapping leaves of cigars and cigarillos can be effected in various mechanical or physical ways; for example, by piercing, by shooting or by burning-in. A particularly simple and effective apparatus for producing perforations of the kind specified by the present invention comprises two rollers which rotate relatively to one another in opposite directions and comprise at their surfaces a plurality of axially arranged pressure application strips and channel strips with needles contained therein. The tobacco product, cigars or cigarillos, are introduced into the channels by way of feed chutes, and the perforations are produced by piercing by means of the needles in conjunction with the pressure application strips.

Appropriate stripping devices co-operate with these rollers and detach from the needles the tobacco products still sticking thereto. An apparatus of this kind is preferably arranged so that the rollers or the pressure application strips and channel strips secured thereto are of a length which is a multiple of the length of the particular tobacco product concerned, so that three, four, five or even six cigars or cigarillos can be perforated at the same time between a pressure application strip and a channel strip.

The pressure application strips and the channel strips are secured on appropriate securing strips of equal width by screws, these being in turn secured on the external peripheral surface of the cylindrical shell of the two rollers which rotate in opposite directions to one another.

The needles producing the perforations are steel needles having a diameter of about 1 mm. and a very sharp fine-tapering point. They are secured in the securing strips for the pressure application strips and channel strips, suitable holes being formed in the pressure application strips and channel strips for the needles, through which holes they project to a greater or lesser extent into the space between the two co-operating strips. The piercing depth can be modified by securing the needles to a greater or lesser depth in the securing strip; that is to say, by clamping them or making them project to a more or less considerable extent through the bores of the pressure application strip and channel strip, modification being possible by the insertion of spacer strips.

The two rollers rotating in opposite directions to one another are coupled to one another and synchronized by means of a spur gear unit. Drive is effected in a manner known per se by means of one of the spur gear wheels.

The entire arrangement can be arranged in a closed housing so that, if necessary, special conditioning operations can also be carried out on the tobacco product in this region. On the other hand, the arrangement in a housing provides protection against dust and noise in any case.

DESCRIPTION OF THE DRAWINGS

The invention will now be explained in connection with a constructional example of an apparatus for carrying out the method shown in the accompanying drawings wherein.

Figure 1:
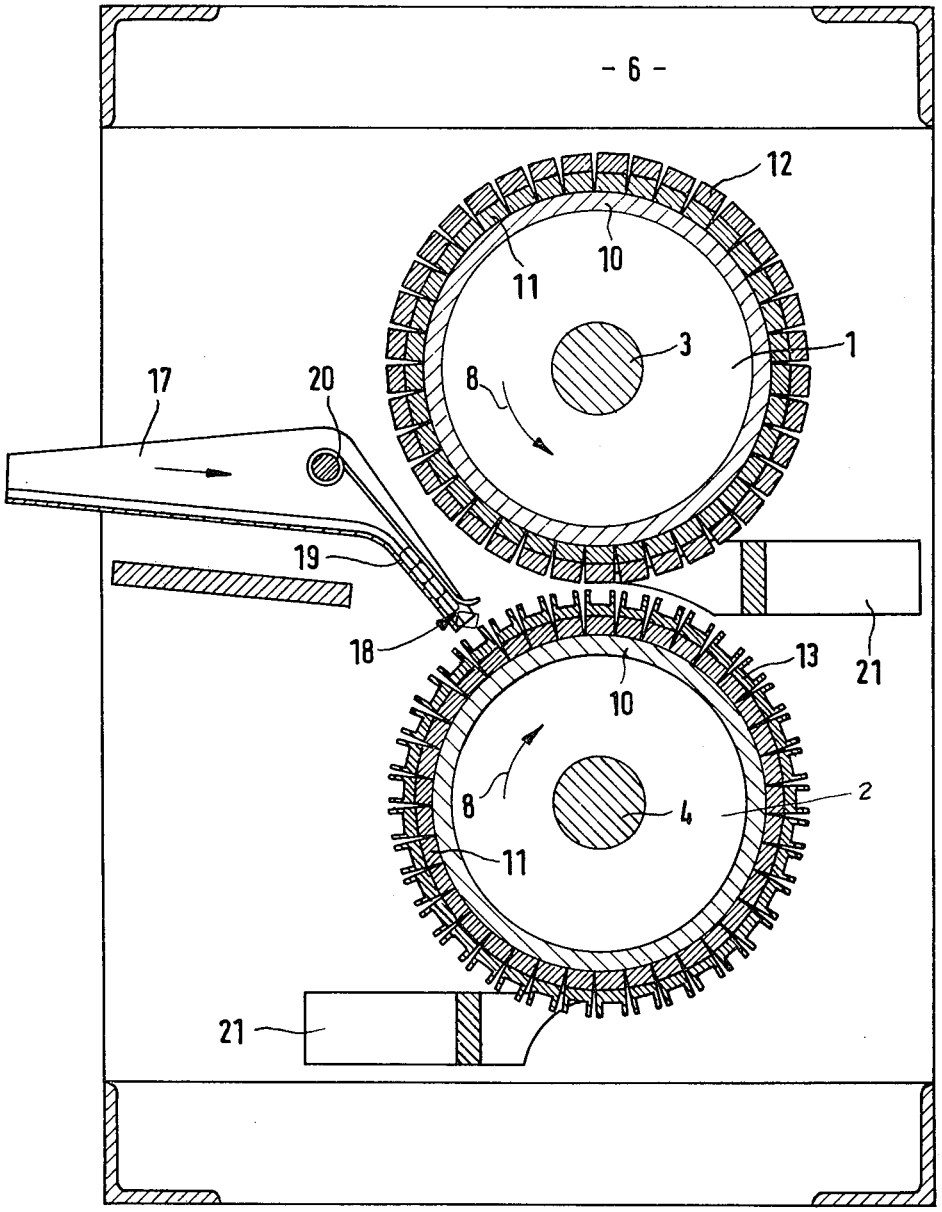
FIG. 1 shows a side view in section on the line A–B of FIG. 3.
Figure 3:
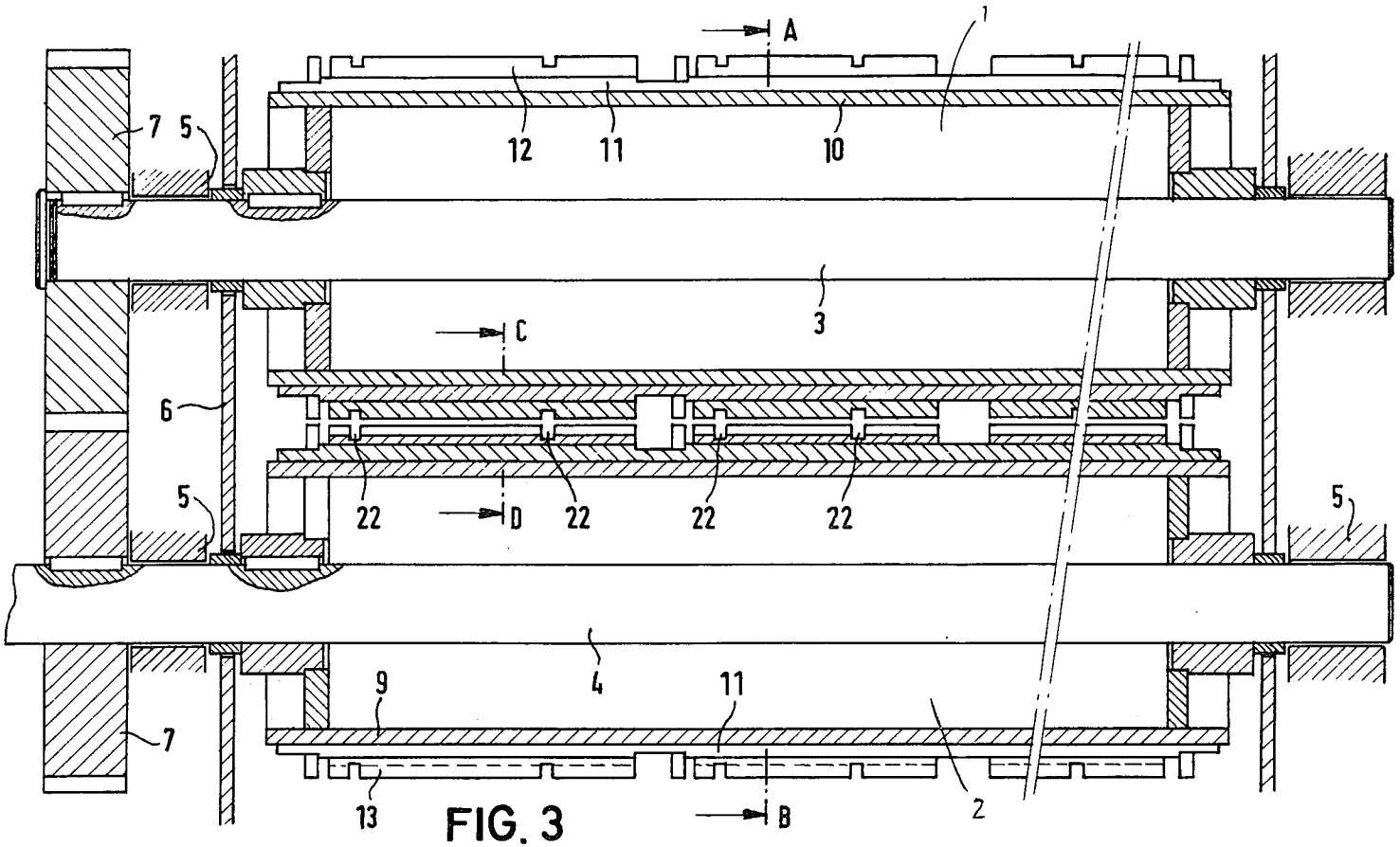
FIG. 3 shows a longitudinal section through the apparatus according to FIG. 1.

As FIG. 1 shows, the apparatus comprises two rollers 1 and 2 which are secured on shafts 3 and 4 which themselves are mounted to be capable of rotating in suitable bearings 5 (FIG. 3) of a housing 6. The shafts 3, 4 of the respective rollers have a spur gear wheel 7 secured on one end, these wheels engaging with one another and drive being applied to one of these gear wheels or a suitable part of a shaft 3. Therefore, the arrangement of the gear wheels causes the rollers to rotate in opposite directions to one another as indicated by the arrows 8 in FIG. 1.

Figure 2:
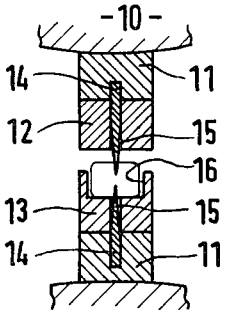
FIG. 2 shows a section on the line C–D of FIG. 3.

Secured, for example by screws, on the external surface 9 of each cylinder 10 of the rollers 1 and 2 are a plurality of securing strips 11, and on these, pressure application strips 12 are secured to roller 1 and channel strips 13 to roller 2. This arrangement is shown again on a larger scale in FIG. 2. This illustration shows that needles 14 are anchored in the securing strips. These needles 14 can be clamped or screwed securely in the securing strips. At any rate, they are so arranged that they project through holes 15 in the pressure application strip 12 and channel strip 13 so that the points of the needles are left free. The extent to which the needles project through these holes 15 is preferably adjustable, and this can be effected by clamping the needles to different depths in the securing strips, or by making the strips 12 and 13 of varying effective thicknesses. The pressure application strips and channel strips arranged on the securing strips and held by screws and therefore replacement is easy. They are made of steel and the channel 16 in the channel strip 13 is made such that it can accomodate the tobacco product which is to be perforated; that is to say, the cigar or cigarillo.

The rotation of the two rollers 1 and 2 is so synchronized and the number of strips provided on the rollers is such that when the strips are situated on a radial plane common to the two rollers, the pressure application strip and channel strip are situated exactly opposite one another. In this position, the two strips have approached one another to the greatest extent, and their needles have penetrated farthest into the space between the two strips.

For perforating tobacco products, the latter are brought by means of a feed chute 17 into the vicinity of the gap between the two rollers, and this can be achieved easily by vibrating the chutes and setting them at a specific inclination. The cigars and cigarillos then fall, as shown at 18 in FIG. 1, into the channels 16 after they have slid down the inclined portion 19 of the chutes. A lightly-bearing plate 20 prevents the advancing products from falling out of the chute. The individual cigars fall into the channels and are moved when the roller 2 rotates in the direction of the arrow 8 toward the pressure application strips 12 of the roller 1. When the two strips 12 and 13 are situtated opposite one another, the needles pierce the tobacco product and thus perforate the wrapping leaf and covering leaf.

The length of the strips 12 and 13 depends on the length of the products to be perforated. Each channel strip is fed from a feed chute with the products which are to be perforated.

The rollers 1 and 2 preferably are of sufficient length that several sets of pressure application and channel strips are arranged longitudinally on the cylindrical surface of the shells 10 of the rollers. In the constructional example described here, three or four sets may be provided. Each set or each channel strip is supplied with cigars or cigarillos by way of a separate feed chute.

To remove from the needles cigars or cigarillos which have been perforated, strippers 21 are provided for each roller, these consisting of narrow plates which pass into the apertures 22 at the ends of the strips 12 and 13. The feeding of the cigars and cigarillos by way of the chute 17 aligns them laterally; that is, in an axial direction relatively to the surface of the rollers, so that the perforations are always made in a specific position in the covering and wrapping leaves of the products. In this way, it is possible to control the distribution of perforations over the tobacco product in such a manner that, for example, in the vicinity of the mouth portion, there are fewer perforations than over the part of the cigar which is to be burned or smoked away.

In accordance with the particular thickness of the product being perforated, it is also possible, instead of a single row of needles distributed over the longitudinal center lines of the strips 12 and 13, to provide a larger number of needles arranged laterally of the center line, thus producing a zig-zag-shaped perforation arrangement or a plurality of rows of perforations which are separated at uniform distances from one another.

The apparatus according to the present invention also makes it possible to arrange the needles at an inclination so that the perforations are effected more or less radially.

The needles preferably have a maximum diameter of 1 mm and a point which is 5 mm in length and is very sharp and slender. By varying the depth to which the needles are fixed in the securing strips 11 or by varying the height at which the pressure application and channel strips are secured on the securing strips by interposing intermediate layers, it is possible to modify the depth of penetration and therefore the perforation opening size, depending on what kind of product is being dealt with.

The strippers for the perforated products consist of contoured plates to insure that the surfaces of the rollers are empty when they again approach the feed chute. They may be given an oscillatory movement by a magnet or by an eccentric drive arrangement. As already mentioned hereinbefore, the feed chute is preferably provided with guide strips whereby the lateral aligning of the fed-in products can be controlled.

The means for securing the needles described hereinbefore may also be modified by placing the pressure application and channel strips 12, 13 onto the securing strip 11 in such a manner that the holes 15 in the strips are adapted to clamp the needles 14 on the said securing strips 11.

In a modified form of this arrangement, the needles may be made radially mobile and secured on devices inside the cylinder so that the needles project both through the cylinder and also through the securing strips 11 and project farthest into the hollow space between pressure application strip and channel strip when these strips are situated closest opposite one another. On further movement of the rollers in the direction of the arrows 8, the needles can then be controlled in such a manner that they withdraw into the holes in the strips so that as a result the products being perforated are stripped off and there is no need for the strippers 21.

It has been found that cigars, for example, which have been treated as proposed by the present invention are much pleasanter to smoke than those which have not been so treated. The perforations draw in secondary air when the user draws on the cigar, and this dilutes the smoke but does not impair the smoker's pleasure, whereas more satisfactory burning is achieved at the same time and thus less CO is formed.

What we claim is:

1. A method of making perforations in tobacco products, such as cigars or cigarillos, comprising the steps of:

a. positioning said tobacco product in a channel secured on an external surface of a first cylindrical shell;

b. moving said channel by rotating said cylindrical shell about a longitudinal axis thereof;

c. contacting said tobacco product with a means for perforating said tobacco product, said perforating means being disposed on an external surface of a second cylindrical shell, said contacting performed by rotating said second shell about a longitudinal axis thereof in parallel and opposed relation to the rotation of said first cylindrical shell, whereby said perforating devices disposed on said second shell are brought into a position opposite said channel and perforations are made in the tobacco product positioned in said channel; and d. removing said tobacco product from said channel.

2. A method according to claim 1 wherein the perforations are distributed non-uniformly.

3. A method according to claim 1 wherein the perforations are arranged in a plurality of rows.

4. An apparatus for perforating tobacco products, such as cigars or cigarillos, comprising in combination:

a. a first cylindrical shell;

b. channel means for accomodating and for moving the tobacco product, said channel means having a bottom and being secured to the external surface of the first cylindrical shell;

c. means for introducing the tobacco product onto the channel means;

d. a second cylindrical shell having a longitudinal axis generally parallel to the longitudinal axis of the first cylindrical shell;

e. means for applying pressure to the tobacco product, said pressure means secured to the external surface of the second cylindrical shell;

f. a means for perforating the tobacco product, said perforating means disposed on the pressure application means; and g. means for rotating the first and the second cylinders about their longitudinal axes in opposed relation, whereby said second perforating means disposed on said pressure application means is brought into a position opposite said first perforating means disposed on said channel means.

5. An apparatus according to claim 4 wherein the introducing means comprises feed chutes.

6. An apparatus according to claim 5 wherein the chutes are oscillatory chutes.

7. An apparatus according to claim 4 wherein the first and second cylindrical shells are interlinked and synchronized by means of gear wheels and the number of pressure application means on said second cylindrical shell corresponds to the number of channel means on said first cylindrical shell.

8. An apparatus according to claim 4 wherein the pressure application means and the channel means are adapted to the length of the products to be perforated.

9. An apparatus according to claim 4 wherein the pressure application means and the channel means are each composed of a plurality of parts arranged one behind the other over the axial length of the cylindrical shells.

10. An apparatus according to claim 4 wherein the pressure application means and the channel means are secured respectively on securing strips in which said perforating means are secured, the pressure application means and the channel means containing holes through which said perforating means extend and out of which they project.

11. An apparatus according to claim 4 including strippers which engage in recesses provided in said channel means and serve to strip the products from said perforating means.

12. An apparatus according to claim 4 further comprising an additional means for perforating the tobacco product, said additional perforating means disposed in the bottom of the channel means.

* * * * *